United States Patent [19]

Hölzl

[11] Patent Number: 5,004,261

[45] Date of Patent: Apr. 2, 1991

[54] ANTI-THEFT DEVICE

[75] Inventor: Klaus Hölzl, Vienna, Austria

[73] Assignee: TMC Corporation, Baar/Zug, Switzerland

[21] Appl. No.: 348,661

[22] PCT Filed: Jun. 22, 1988

[86] PCT No.: PCT/EP88/00547

§ 371 Date: Apr. 11, 1989

§ 102(e) Date: Apr. 11, 1989

[87] PCT Pub. No.: WO89/01355

PCT Pub. Date: Feb. 23, 1989

[30] Foreign Application Priority Data

Aug. 11, 1987 [AT] Austria ..... 2024/87

[51] Int. Cl.[5] ..... A63C 11/02

[52] U.S. Cl. ..... 280/612; 280/611; 280/809; 70/58

[58] Field of Search ..... 280/612, 611, 809, 814; 70/257, 58

[56] References Cited

U.S. PATENT DOCUMENTS 3,528,672 9/1970 Wunder ..... 280/612

4,598,933 7/1986 Hoelzl ..... 70/58

FOREIGN PATENT DOCUMENTS 290350 5/1971 Austria .

228599 7/1987 European Pat. Off. .

2710096 9/1978 Fed. Rep. of Germany ..... 70/58

2827182 1/1980 Fed. Rep. of Germany ..... 280/814

2194459 3/1974 France .

2542207 9/1984 France .

0637842 8/1983 Switzerland .

*Primary Examiner*—David M. Mitchell

*Attorney, Agent, or Firm*—Flynn, Thiel, Boutell & Tanis

[57] ABSTRACT

An anti-theft device for a safety ski binding comprising a jaw having catches and abutments for supporting a detent arrangement holding a sole retainer in a detent position. To be able to construct a device of this type in such a way, if possible, that there is hardly any possibility of a successful unauthorized manipulation which does not impair the function of the binding proper, there is provided a blocking arrangement (100) having a blocking position in which a member coupled with an abutment (102, 21) or a catch (10, 11) is retained in its position corresponding to the open or release position of the binding.

17 Claims, 8 Drawing Sheets

ANTI-THEFT DEVICE

Figure 1:
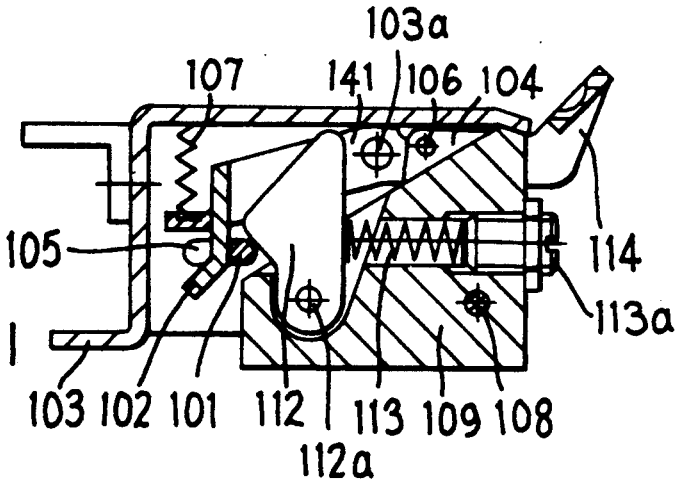

This invention relates to an anti-theft device for a safety ski binding comprising a jaw having at least one sole retainer adapted to be selectively brought into a detent position and into an open position, and at least one mechanically or electronically releasable detent means for holding the sole retainer against a resilient force in the detent position, the structural members effecting the detent or open position of the sole retainer being coupled with each other in a non-positive way.

Anti-theft devices of this type are for instance known from Austrian patent specification No. 381 455. As for this known solution, there is provided a lock which fixes the binding in a position. This, however, has the resultant disadvantage that the lock must be accessible from the outside, whereby on the one hand an unauthorized manipulation of exactly this lock cannot be prevented, and the device is thus only of questionable value because the binding remains evidently operative, for instance after the lock has been destroyed, and whereby on the other hand considerable problems caused by the formation of ice on the lock may arise when the skis are used and corresponding precautionary measures are not taken for the maintenance thereof.

Furthermore, it has already been suggested in Swiss patent specification No. 637 842 that a lockable blocking of the ski brake should be provided when there is a binding having an integrated ski brake. This has also the resultant disadvantage that the elements causing the blocking are accessible from the outside and can be made inoperative by a corresponding application of force, with no damage to the binding proper having to be assumed from the start so that an operative binding can definitely be reckoned with even after a corresponding manipulation of the ski brake.

Moreover, a safety ski binding has been suggested in Austrian patent specification No. 290 350 wherein a release member adapted to be triggered via a transmitter is arranged in the locking mechanism. With the help of the transmitter it is thus possible to release the binding when there is the risk of falling, and to separate the ski. This, however, does not at all provide a protection against theft because the binding can be locked and unlocked by means of a manual release without difficulty.

It is the object of the present invention to avoid these disadvantages and to provide an anti-theft device of the type mentioned at the outset, wherein the device is arranged in a substantially protected way and wherein when force is used, inoperativeness of the binding must be reckoned with so that such an attempt is not at all made because of the obvious futility of such an undertaking.

According to the invention this is accomplished by providing a blocking means which is adapted to be selectively brought into an open or blocking position with the aid of a transmitting means via a receiving means and which in its blocking position assumes a position which allows locking into a blocking position only when the binding is in an open position, and in which the detent means is prevented from returning into a position corresponding to the closed position of the binding.

As a result of these measures, it is possible to fix the binding in its open position so that the jaw can no longer be moved out of this blocked position, and use of the binding is thus made impossible. The blocking means can expediently be arranged in the jaw so that this means is not accessible from the outside. An unauthorized manipulation of the blocking means is definitely prevented as well because this means can only be influenced by corresponding signals from an associated transmitter.

In principle, it would also be possible to lock the binding by means of the anti-theft device in the closed position thereof. The lawful user, however, would always have to pay attention that the device is only activated when the binding is in the closed position. Otherwise, there would be the risk that the binding is stepped into when the anti-theft device is activated in the open position of the binding, and the device can then no longer fulfill its anti-theft task. This would expose the lawful user to considerable danger and also lead to liability problems in case of an unauthorized use. It must here be taken into account that the risk of such a wrong operation of the anti-theft device is relatively great because most of the skiers step out of the binding and set the skis aside in the open position of the binding or in a position ready for re-entry, especially when there are only short breaks.

In accordance with another feature of the present invention, in a safety ski binding comprising a jaw having an electronic evaluation circuit connected to force transducers supplying electrical signals, to an electrical power supply, such as a battery, and an electromagnetic release member, the release member comprising at least one detent arrangement and driving a control member for controlling a locking mechanism acting on the jaw, the electromechanical release member being preferably arranged with at least a portion of the locking mechanism in a housing, there is provided a blocking means which is adapted to be selectively brought into an open or blocking position with the aid of a transmitting means via a receiving means and which in its blocking position breaks the circuit of the electrical power supply.

According to the respective construction of the jaw either the locking thereof is made impossible by this measure or at least the proper function thereof as a safety binding. To prevent possible mistakes on the part of the rightful user, it may be expedient when the transmitting means can only be operated deliberately. In this respect a two-key operation for releasing the transmitter presents itself right away, the transmitter being only activated by this operation when two keys are depressed at the same time. An unintentional operation of the transmitter, which is for instance provided on the equipment, is definitely prevented thereby when the skier falls down.

In a preferred embodiment of the present invention, the transmitting means is separated from the binding and preferably comprises a shift register which is connected to a memory loaded with a specific code or has such a memory, and also to a clock generator, and which at the output side is in communication with a transmitter.

As a result of this measure, the binding can be brought in a very simple and easy way into the blocked state or the operable state, the transmitter being characterized by a very simple construction.

There may also be a signal button which is arranged in the transmitting means upstream of the shift register for supplying signals corresponding to the code loaded into the memory, as well as a final amplifier which is arranged between the shift register and the transmitter, the latter being an infrared transmitter.

It is thus possible—by simply pressing a button—to output corresponding signals for reversing the blocking means of the binding through the transmitter, with the resultant advantage of a relatively narrow range following from the construction of the transmitter as an infrared transmitter, any signal transmission to skis which are nearby and equipped with a similar binding being thereby prevented and thus any undesired influence thereon.

Furthermore, the receiving means provided for receiving signals transmitted wirelessly by the transmitting device may include a code evaluation circuit comprising a shift register and a comparator which is arranged downstream thereof and which is connected to a memory loaded with a specific code or has such a memory and outputs a pulse when there is correspondence between the received code and the stored code.

This results in a simple construction of the receiving means with the help of which the signals received can be infallibly distinguished with respect to signals assigned or not assigned to the binding, relatively small shift registers being sufficient for this purpose.

In accordance with another feature of the present invention, there is provided a blocking means which comprises an electromagnetic means which is reversible via pulses and adapted to be brought into two inoperative positions and whose armature itself is formed as a blocking member, or a member controlled by the armature forms the blocking member.

A reliably operating blocking means which is of a very simple construction and can be triggered easily is thereby accomplished.

A receiving means of an especially simple construction is obtained when the receiving means has arranged downstream thereof a locking circuit which substantially consists of a divider for reducing the pulses in the ratio of 1:2, and of two AND gates and a commutator circuit which is arranged downstream thereof and in the diagonal branch of which the coil of the blocking means is located and when each signal of the comparator of the receiving means is adapted to tilt a flip-flop which is arranged downstream and by the pulses of which the coil is acted on.

In a preferred embodiment of the present invention, the blocking member is formed by a blocking pin or blocking hook which is movably arranged in the blocking means in the direction of its longitudinal extension, or constructed as a detent which is pivotable relative to the blocking means in a plane transverse to the plane of movement of the structural member to be blocked, and this blocking member is operative in the path of travel of an abutment, stop or catch.

The jaw is thereby blocked in the area of its locking mechanism, whereby the blocking member can be arranged such that a manipulation of the sole holding-down device, which is accesssible from the outside, does not affect same. As a result, the blocking member itself may be of a relatively small and weak construction, whereby the space required for the blocking member can be kept relatively small.

If the blocking member controlled by the armature is arranged separately, the member can be expediently triggered via a spring which is positioned as a coupling member between the armature and the blocking member. It is thereby possible to bring the blocking member into a ready position at any time, the blocking member moving into the blocking position when the detent mechanism of the jaw reaches a specific position. Since the blocking means assumes its blocking position in the open position of the binding, the user is optimally protected from the consequences of a possible mistake or wrong operation.

With respect to a binding comprising a jaw wherein a release lever biased towards its inoperative position directly acts on the lock of the sole retainer, at least when being deflected into its release position, another feature of the present invention discloses that the blocking means acts in its blocking position on the path of travel of a member of the release lever, the member carrying the stop, which is operative as an abutment, and being located in the interior of the jaw, and inhibits the return thereof from the release position, the release lever preferably comprising a hinge which is positioned in the interior of the jaw and allows the taking along of the inner member of the release lever by the outer member thereof only in the direction of actuation for deflection into the release position thereof.

This design is especially suited for bindings of a purely mechanical construction and is characterized by a very simple construction. The division of the release lever into two partial levers connected through the hinge has the advantage that no force is applied to the blocking means via the release lever. It is thereby ensured at the same time that the blocking means cannot be made inoperative by the use of force from the outside.

To prevent an external manipulation of the blocking means through parts of the jaw when there is a binding of the invention comprising a sole retainer which is spring-biased towards its deflected position and comprises a dog which when the sole retainer is deflected into the release position thereof, is adapted to be brought into contact with a catch being in a released position or with an abutment being in its released position and returns the catch or the abutment into the operative position thereof, the dog may be formed as a projection which is constructed in the form of a spring, preferably a leaf spring, and which is in operative communication with a projection on the outer support arm.

The force transmitted from the sole retainer to the abutment blocked by the blocking means or to the catch is also interrupted thereby, and the exertion of inadmissibly great forces on the blocking means is definitely prevented.

Furthermore, the blocking member of the blocking means which is advantageously formed by the pin adapted to be slid into the path of travel of a member coupled with the catch or the abutment may here be connected via a spring to its drive formed preferably by the electomagnetic means, said means urging the pin towards a final position determined by a stop which is also movable by the drive.

The operativeness of the device as an anti-theft device is thereby not all jeopardized because for stepping into a binding it is in any case necessary to bring the jaws into their open position. In the ready state of the blocking member same moves, however, into its blocking position and definitely prevents the locking of the binding in its closed position. This, however, is noticed by the user at the same time and, provided that he has the transmitter with him, he can bring the binding again into its ready state in which locking of the binding in the closed position is possible.

An especially simple construction of such a blocking means is obtained when the stop is formed by a sleeve or bushing supported in the armature of the electromagnetic means, said armature being formed as a carriage.

To enable the user to control the state of his binding in a simple way, the blocking element may be coupled according to another feature of the present invention with a display device whose indicators are positioned in the area of a viewing window of the jaw in one of the two inoperative positions of the blocking means.

Another embodiment of the blocking member which is very advantageous with respect to a compact and small-sized construction of the jaw is obtained when the blocking member is formed by a break switch which is interconnected in the electric main circuit of the binding and which in the blocking position of the blocking means is in its "off" position.

Figure 7:
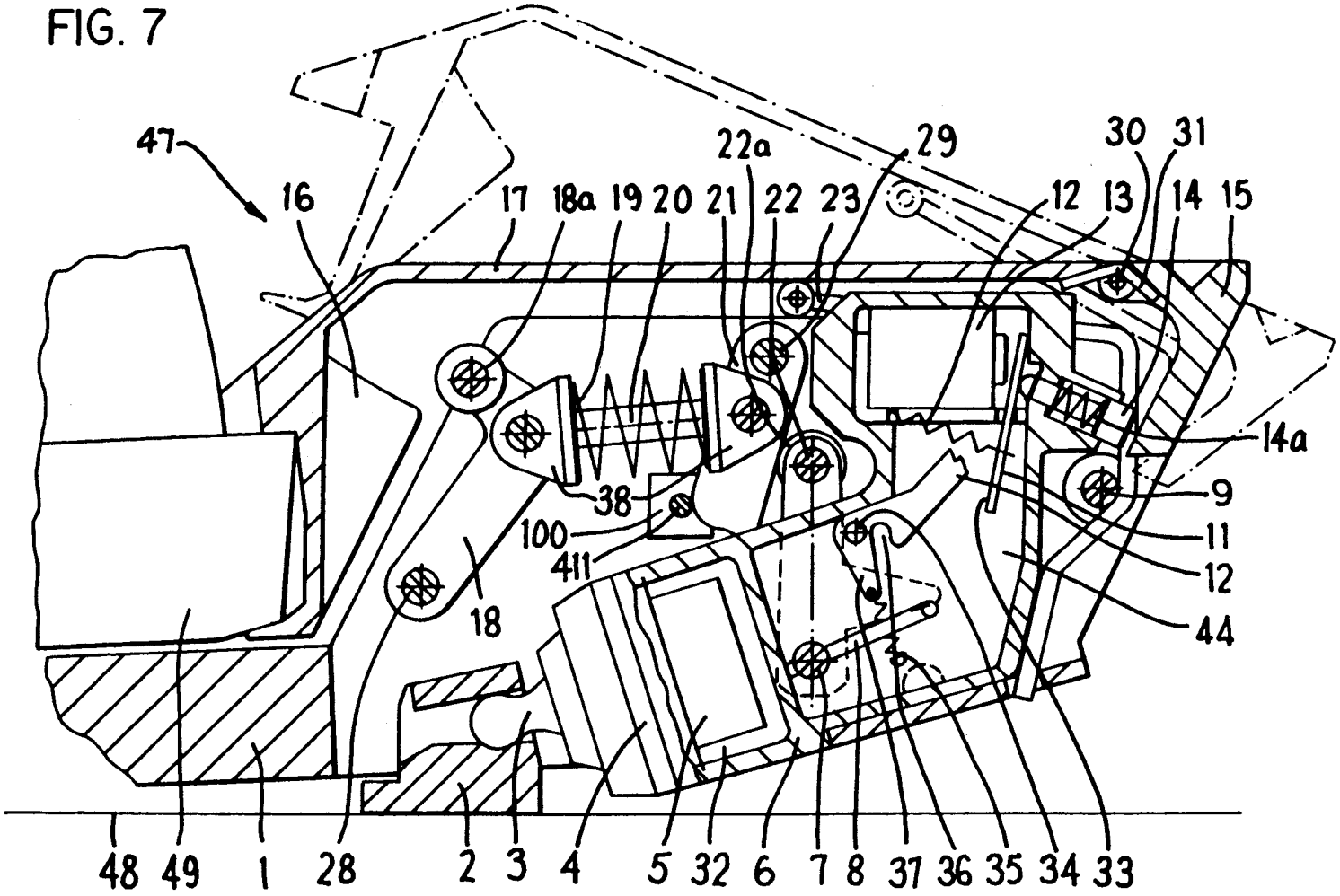
Figure 8:
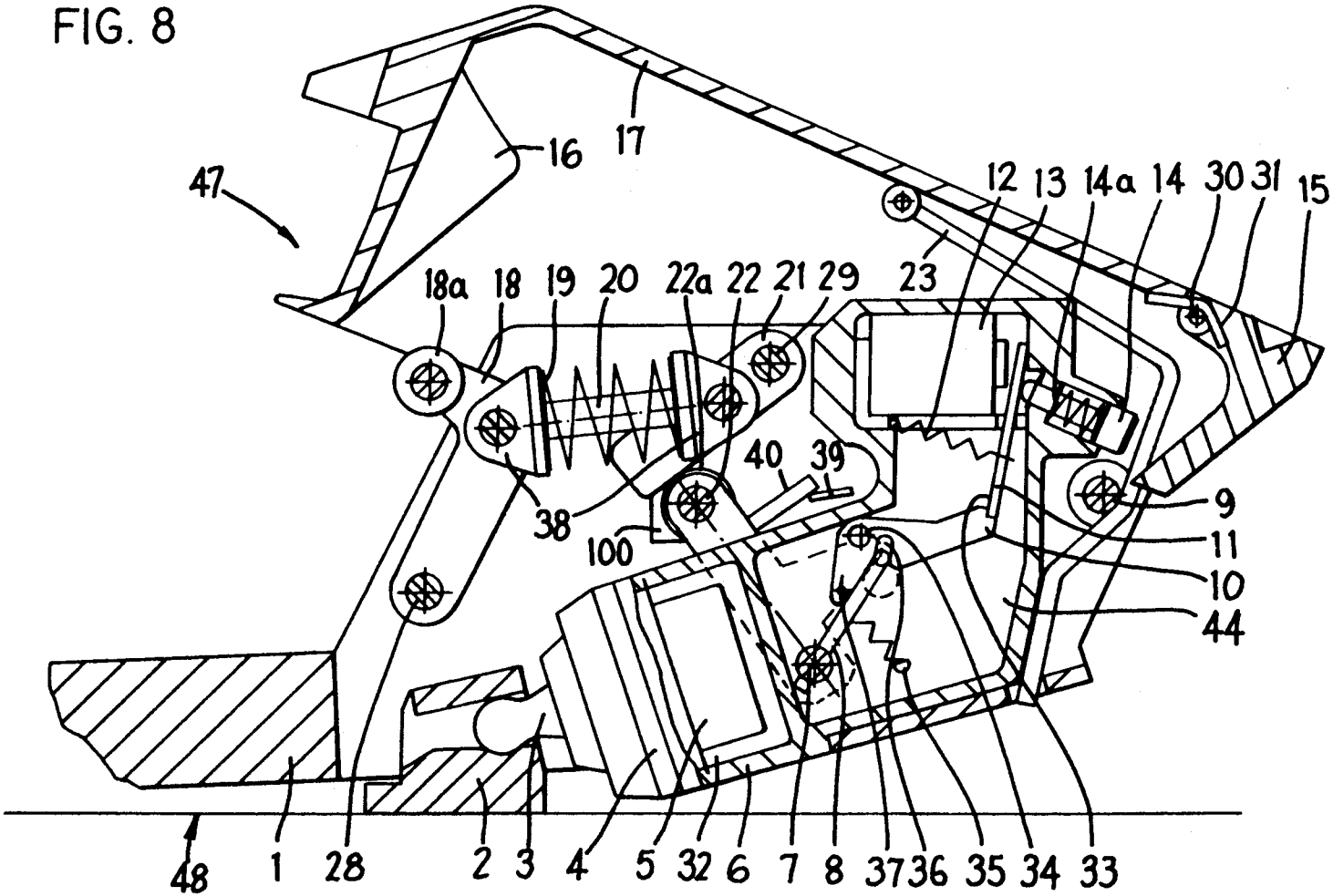
Figure 9:
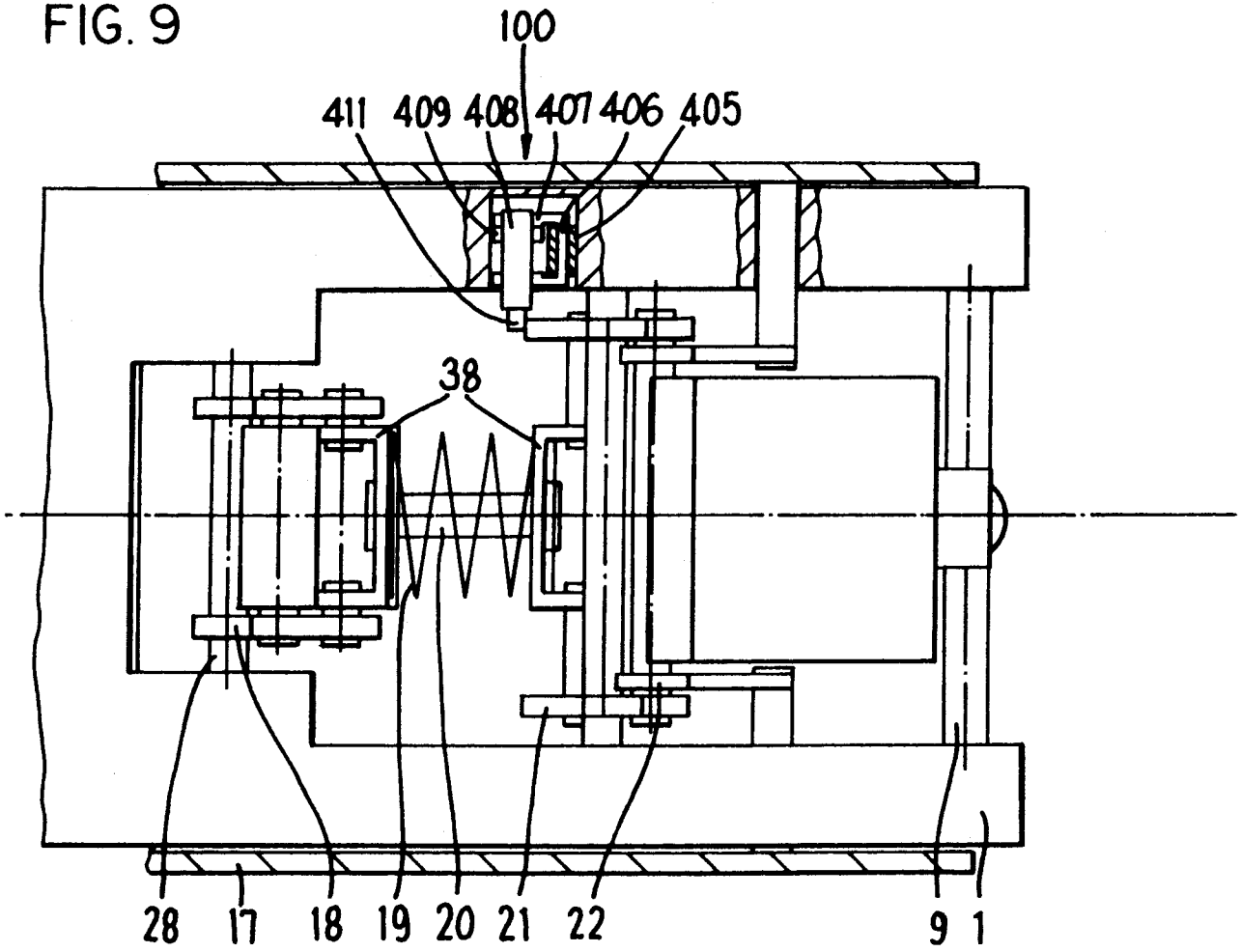
Figure 10A:
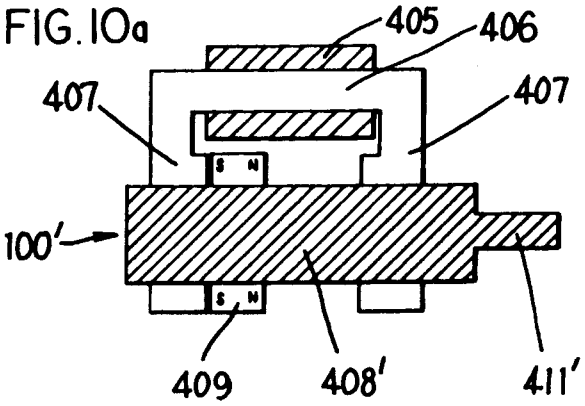
Figure 10:
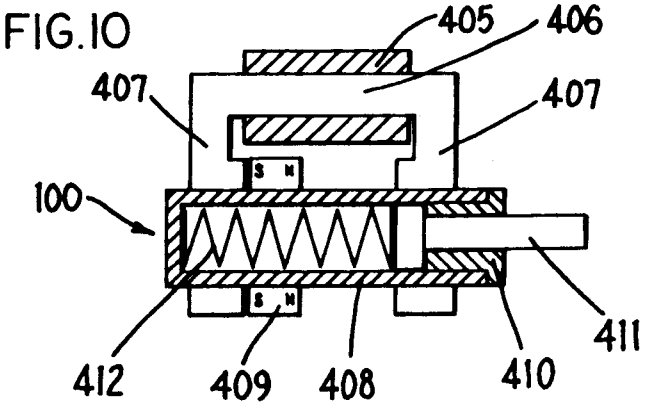
Figure 11:
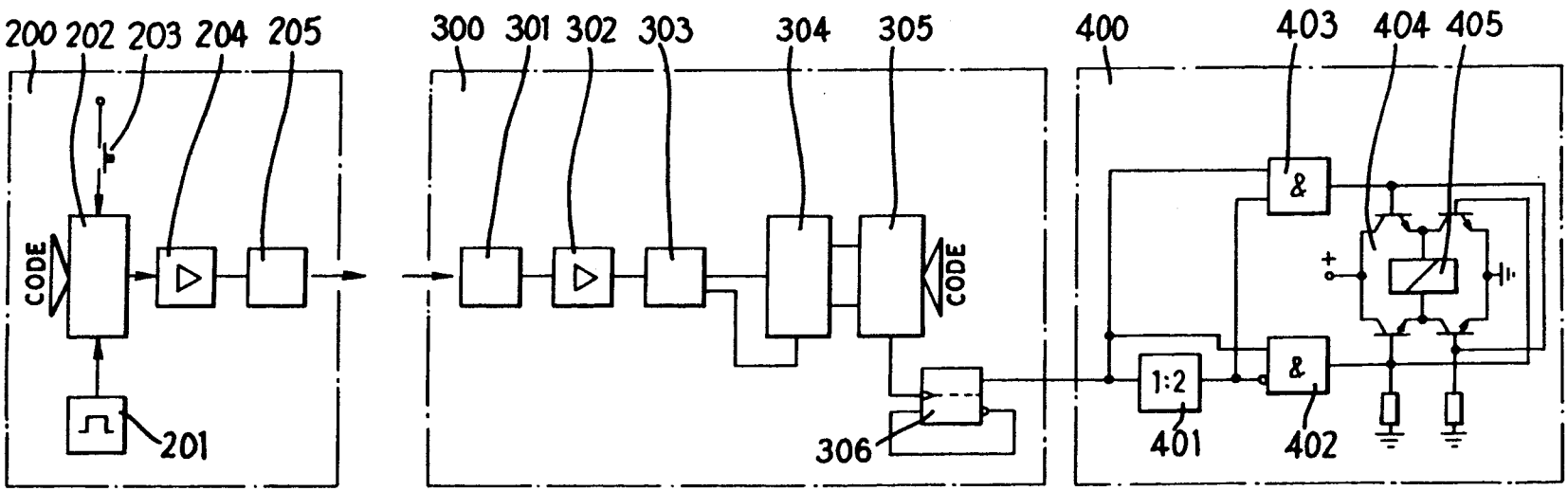
Figure 10A:
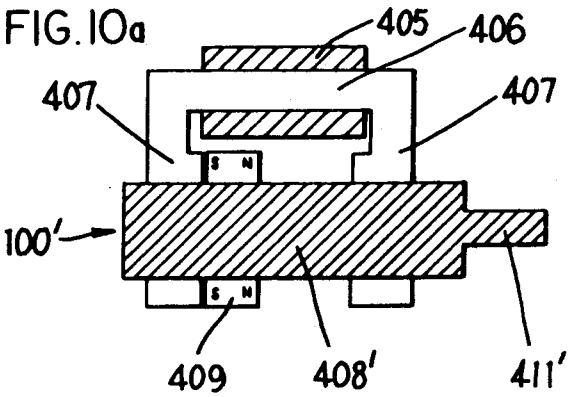
Figure 10:
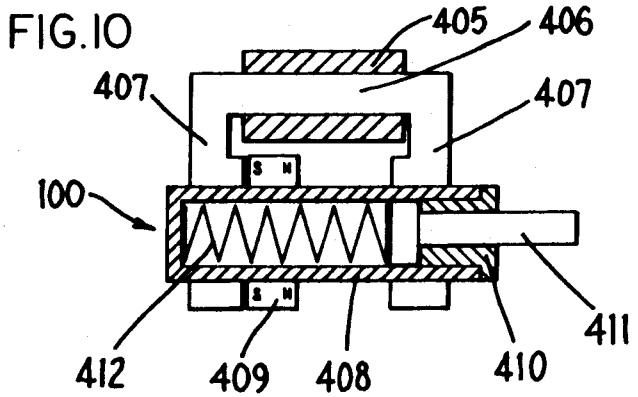
Figure 11:
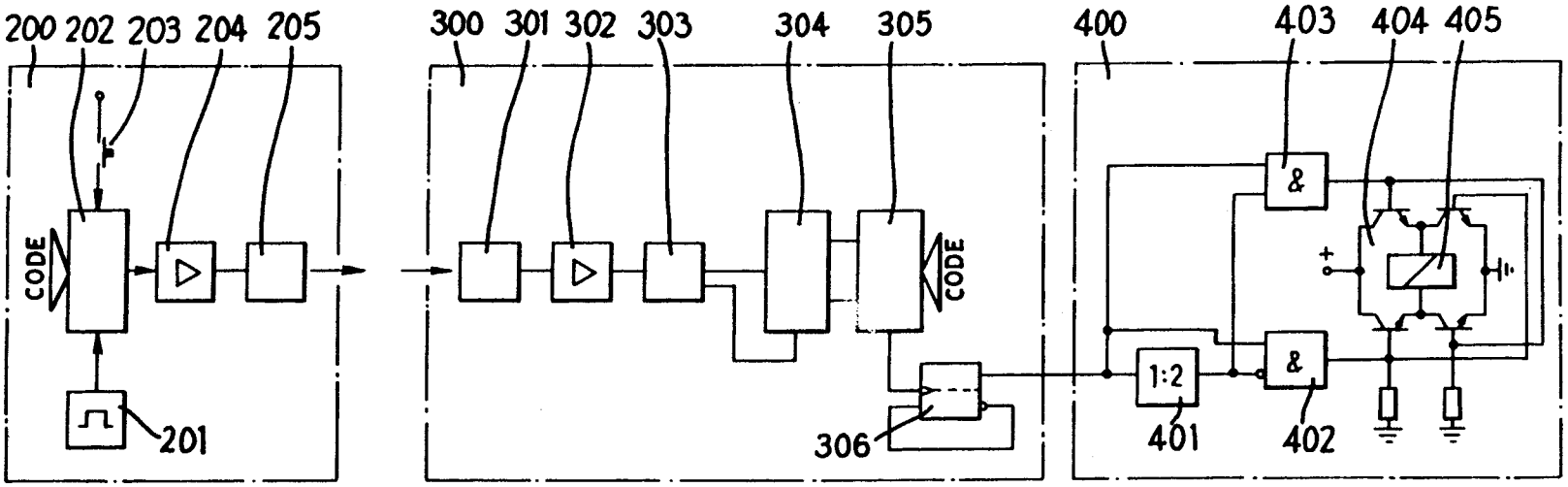

The present invention will be explained in greater detail with the help of the drawing, wherein FIGS. 1 to 4 diagrammatically show a first embodiment of a jaw provided with an anti-theft device of the invention, FIGS. 5 to 8 diagrammatically show another embodiment of a binding with an anti-theft device of the invention, FIG. 9 shows the mechanical construction of a blocking means, FIGS. 10 and 10*a* diagrammatically show two different embodiments of a blocking means, and FIG. 11 shows a block diagram of a transmitting and receiving means comprising an evaluation circuit for triggering the blocking means.

FIGS. 1 to 4 show a releasable jaw of a binding of a purely mechanical construction. As far as this binding is concerned, the sole retainer 103 is in communication with a retaining member 101 which in conjunction with an abutment formed as a stop 102 and a catch 112 acting as a holding-down member is adapted to be held in its locked working position.

In the jaw shown in these figures, the catch 112 is pivotably supported in the basic body 109 and biased by the spring 113 towards the detent position in which the catch overlaps the retaining member 101.

The release lever 104 is of a two-part construction, its member 114 projecting from the jaw being connected—through a hinge 106 disposed in the interior of the jaw—to the member 141 of the release member 104 which is pivotably supported in the sole retainer 103. This hinge permits a counterclockwise pivotal movement of the outer member 114 relative to the inner member 141, but not a clockwise pivotal movement. This can for instance be accomplished in that the end of the member 114 engages the bifurcated end of the member 141 and is connected thereto via an axis, the portion of the member located above the hinge axis being rounded off whilst the portion located below this axis is in close contact with the bottom of the bifurcated head of the member 141.

The inner member 141 of the release lever 104 carries in its free end portion a stop 101 against which, as can be seen from FIG. 1, the retaining member 101 overlapped by the catch 112 abuts. Upon release of the safety device the sole retainer 103 pivots upwards about the axis 108 by reason of the forces acting thereon, the retaining member 101, which cannot escape because of the stop 102, pivoting the catch 112 back against the force of the spring 113.

Figure 2:
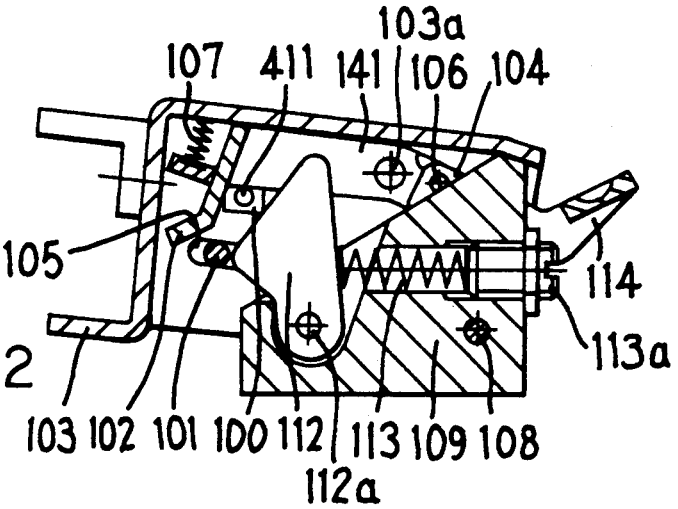
Figure 3:
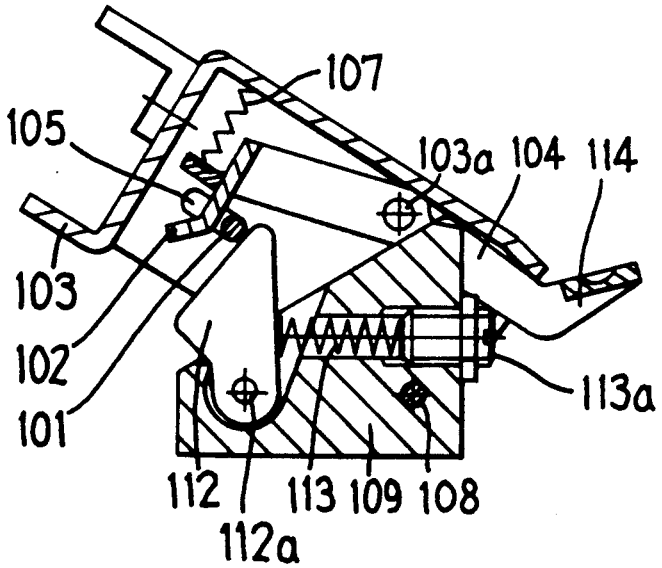

When the release member is pivoted from its spring-biased inoperative position, which can be seen from FIG. 1, into its release position, which can be seen from FIG. 2, the stop 102 is pivoted upwards away from the retaining member 101, the outer member 114 taking along the inner member 141 via the hinge 106. As a result, the spring-biased catch 112 can now urge forwards the retaining member 101 displaceably held in slots 105 of the sole retainer 103, whereby the catch can perform a counterclockwise rotation to such an extent that it is disengaged from the retaining member 101, and the sole retainer 103 can freely pivot upwards.

Figure 4:
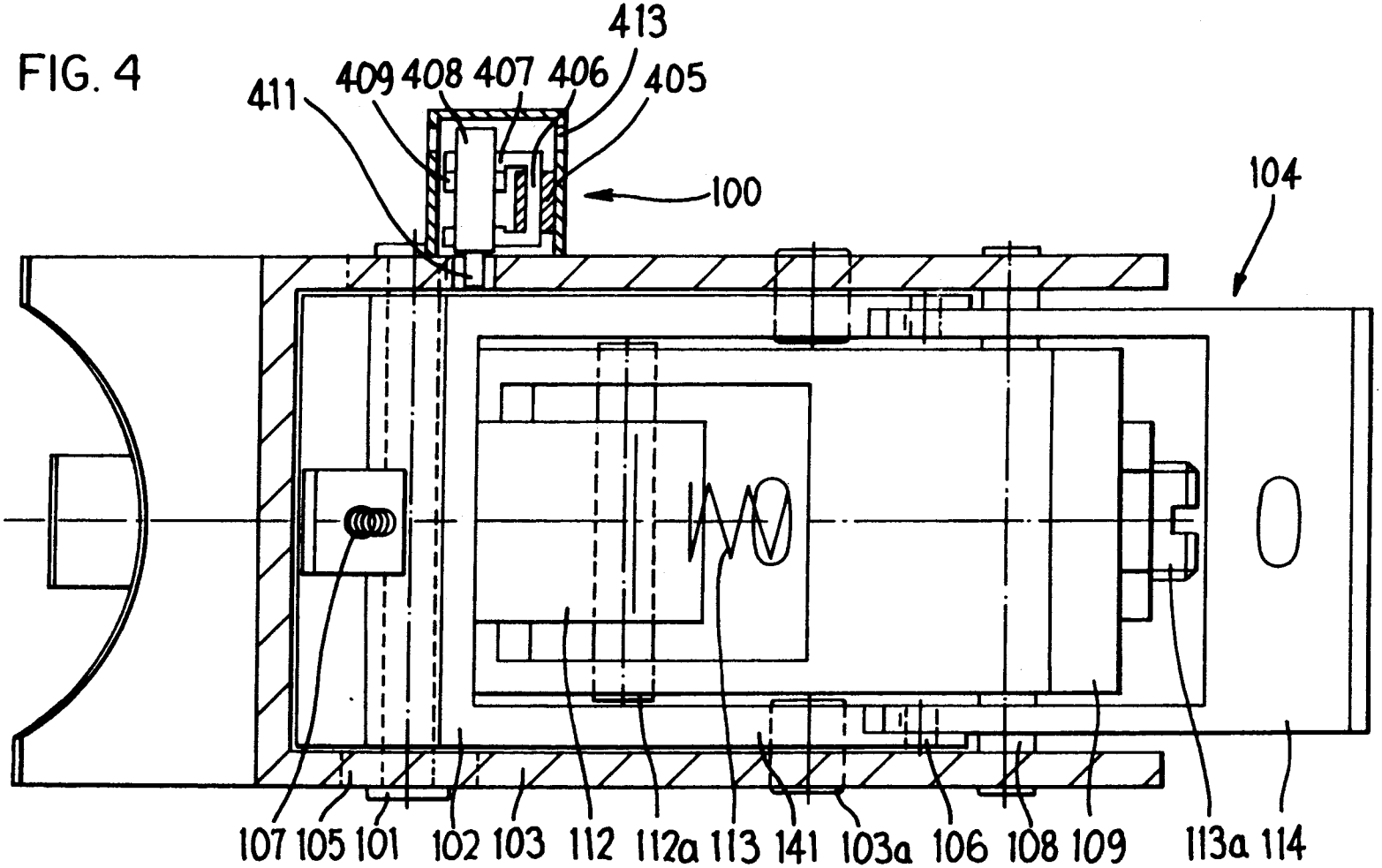

When the blocking means 100 disposed in the interior of the sole retainer 103 and held by same is in its blocking position, a pin 411 acts on the path of travel of the member 141 of the release member 104 and prevents said member from returning into its springbiased inoperative position in which the abutment 102 prevents a displacement of the retaining member 101. Locking of the sole retainer 103 in the working position thereof is however made impossible thereby, and thus any skiing (FIG. 4).

However, by reason of the hinge 106 disposed in the interior of the sole retainer 103, it is also not possible—through rotation of the outer member 114 of the release lever 104—to exert any force on the blocking means 100 so as to possibly make it inoperative because the hinge 106 readily permits a counterclockwise rotation of said member.

It is only after the blocking means 100 has returned into its release position that the inner member 141 of the release lever 104, and thus the stop 102, too, can return into its inoperative position in which locking of the sole retainer 103 is possible, with the spring 107 supporting the return of the inner member 141 of the release lever 104. The outer member 114 of the release lever is here also taken along via the hinge 106.

The construction and function of the blocking means 100 and a variant 100' thereof will be explained later on the basis of FIGS. 10 and 10*a*.

The binding shown in FIG. 5 is constructed as a plate binding, the binding plate 1 being rotatable about a spherical journal 46 which is arranged in the area of the piercing point of the axis of the tibia of the skier with the ski plane and allows a rotation of the binding plate in the plane of the ski. In the front portion of the binding plate 1 same has a transverse axis 41 which passes through a slot 42 extending in the longitudinal direciton of the ski and pertaining to a holding device 45 which is fixedly arranged in the ski and projects with a great play on all sides into a recess arranged on the bottom side of the binding plate 1, thereby allowing a limited rotation of the binding plate about the journal 46 and an upward pivotal movement of the binding plate 1 about the axis 41.

Furthermore, a rigid, non-releasable toe jaw 43 is adjustably and lockably held in the front portion of the binding plate 1 in the longitudinal direction thereof.

The releasable heel jaw 47 arranged in the rear portion of the binding plate is connected to the binding plate 1 and adapted to be pivoted upwards about the axis 9 which is held in a rising rib of the binding plate 1. Furthermore, the binding plate is fixedly connected in its rear portion to a circuit module 44 which is supported via force transducers 4 and a sensing element 3 provided with a ball-headed end in an abutment 2 fixed to the ski.

The position of the binding plate 1 is thereby substantially fixed, which, however, allows a movement of the binding plate 1 to the extent of the sensing paths of the force transducers 4 which by reason of the fixed rotational centers of the binding plate about the journal 46 and the axis 41 permit the detection of the moments ±Mz and ±My acting on the binding plate 1.

The members which belong to the locking mechanism of the jaw and are arranged inside the housing 6 of the circuit module 44 are always referred to as "inner" members and the members of the locking mechanism arranged outside this housing 6 as "outer" members.

Figure 6:
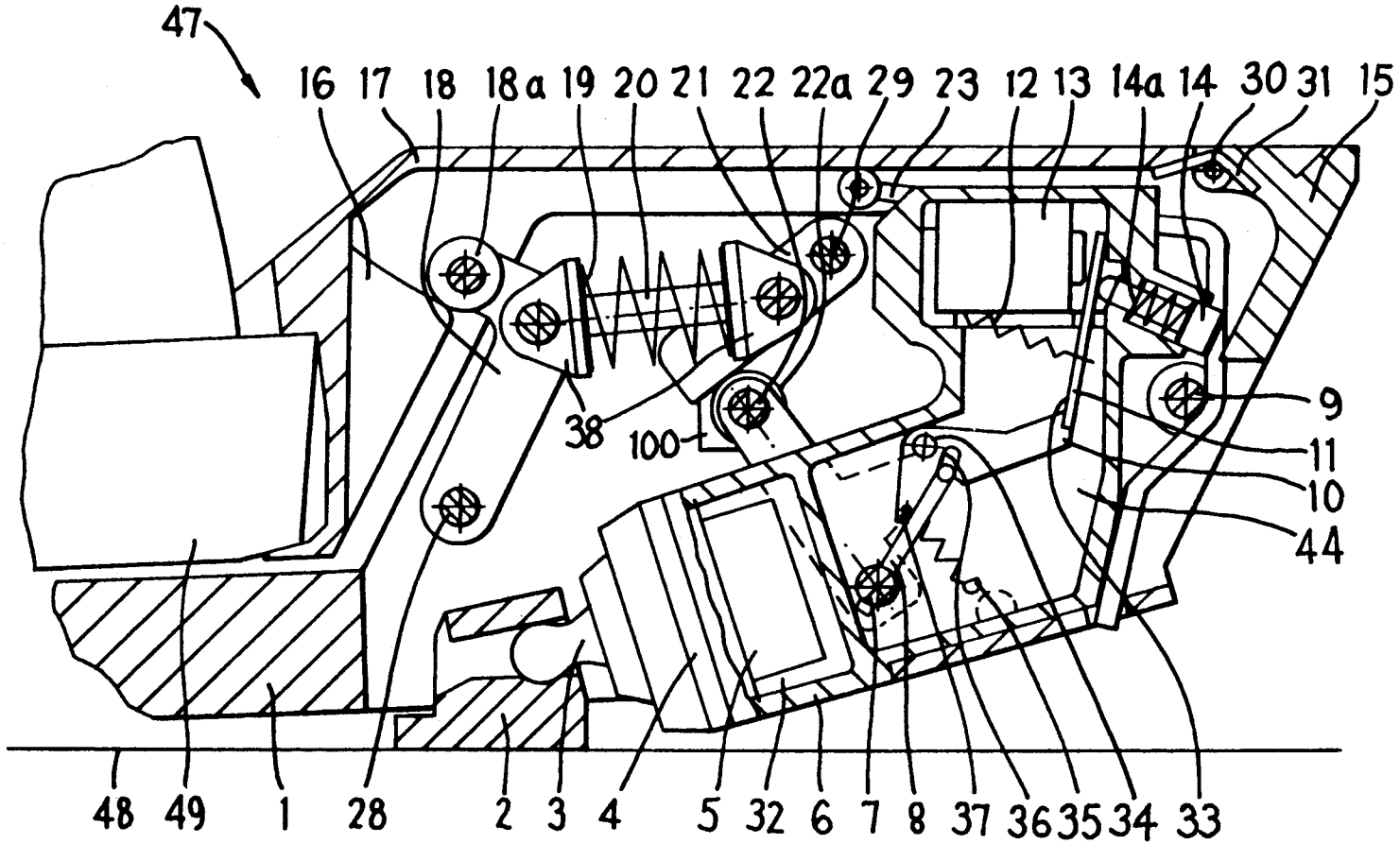

As far as the heel jaw 47 is concerned, there is provided a usual opening spring 23 which is supported on the binding plate 1 and the sole retainer 17 and biases the latter towards its upwardly pivoted final position, which is outlined in broken lines in FIG. 6 and shown in full lines in FIG. 7.

The sole retainer 17 has a detent nose 16 which projects towards the interior thereof and which in the locked position of the binding is overlapped by a roll 18*a* held on an outer detent lever 18. This outer detent lever 18 is pivotably held on a rotational axis 28 which in turn is fixed to the member of the heel jaw secured to the binding plate. A coupling rod 20 connecting the outer detent lever 18 to another support member 21 which is pivotably held about a rotational axis 29 rigidly connected to the binding plate 1 and acts as an abutment is hinged to the outer detent lever 18, the coupling rod 20 being held with a great play and displaceably in its longitudinal direction in supports 38 which are hinged to said two members and belong to a tension spring 19.

The tension spring 19 which urges the two members apart is operative between the members connected to each other through the coupling rod 20. In the supported state of the support member 21 the roll 18*a* of the outer detent lever 18 is thus pressed against the detent nose 16, whereby an upward pivotal movement of the sole retainer 17 is prevented.

A manual opening button 15 is pivotably supported in the heel jaw 47 via an axis 30, said button 15 being biased towards its inoperative position by means of a spring 31. When the manual opening button is pushed, same performs a counterclockwise pivotal movement, i.e. against the force of the spring 31, and acts on the release pin 14 which is retained in a passage of the housing and biased by means of a spring 14*a* towards its inoperative position shown in the figures. In the embodiments shown, this release pin 14 is sealed relative to the housing 6 by means of an O ring; however, it is also possible to seal the release pin by means of a diaphragm which is stretched over the free end of the release pin or constructed as a part of the housing and with which the manual opening button 15 can be brought into abutment.

The sensing element 3 is supported via a ball-jointed receiving device on the abutment 2 fixed to the ski. This sensing element 3 has force transducers 4 for sensing the moments ±My and ±Mz occurring on the binding plate 1 about the rotational axes thereof and for converting same into electrical signals. These force transducers 4 which may be designed in any way, for instance as piezoelectric transducers or as strain gages, are connected to the housing 6 of the circuit module 44 in which the battery, the evaluation circuit 5, as well as an electromechanical release element, such as a solenoid as in the embodiments shown, and parts of the mechanical locking system of the binding are accommodated.

The chamber (not shown) accommodating the battery, as well as the chamber 32 which accommodates the electronic evaluation circuit 5 and is positioned in front of the chamber accommodating the battery are annexed to the housing 6 of the circuit module 44 or formed by members thereof. The electromechanical release element is formed by a solenoid which includes a tilt armature 11 and is connected through lines (not shown) to the evaluation circuit 5 and the battery, respectively. The tilt armature 11 is biased by means of a weak return spring 12 towards its position released from the core and includes a detent surface 33 against which a portion of the locking mechanism of the sole retainer 17 can be abutted.

In the ready state of the binding a latch-type inner lever 10 abuts against the released tilt armature 11. This inner lever 10 is pivotably held about an axis 34 retained in the housing 5 and biased by means of a weak spring 35 towards its unlocking position. This inner lever 10 has a recess 36 which is open at the edge. An inner detent arm 8 engages this recess with its bent end. This inner detent arm 8 which may also be constructed as a bow is fixedly attached to a shaft 7 tightly passed through the housing 6.

Outside the housing 6 an outer detent arm 22 which for reasons of a low-friction construction is formed as a roll lever is fixedly attached to this shaft 7. In the ready state of the binding this outer detent arm 22 supports an outer support member 21 which is pivotable about an axis 29 rigidly connected to the binding plate and which is formed as a support lever and serves as an abutment for the tension spring 19 which, as has already been explained, urges the outer detent lever 18 and thus the roll 18*a* thereof towards the detent nose 16 of the heel jaw 17.

As is outlined in dash-dotted lines in FIG. 6, the outer support member 21 is supported on the outer detent arm 22 such that the outer support member 21 forms together with the outer detent arm 22 an angle slightly exceeding 90° so as to exert a torque on the outer detent arm 22, said torque biasing the latter towards the unlocking position thereof. This torque is absorbed via the inner detent arm 8 engaging the recess 36 of the inner lever 10, and the inner lever 10 which in turn is supported on the detent surface 33 of the tilt armature 11.

When the release pin 14 is pressed against the tilt armature 11 by pushing the manual opening button 15, or when the solenoid attracts the tilt armature 11, for which only small forces are necessary because of the weak return spring 12 and the frictional forces which are only small because of the lever ratios and the support by means of the catch, the inner lever 10 loses its support and the torque acting on the outer detent arm 22 rotates the inner detent arm 8 out of the recess 36, whereby the detent arm 8 loses its support. As a result, the outer support member 21 can also rotate into the position shown in FIG. 7, whereby the outer detent lever 18 provided with the roll 18*a* loses its contact with the detent nose 16 of the sole retainer 17 and can pivot upwards after the release of the sole by virtue of the outer forces acting thereon.

When the sole retainer 17 is pivoted upwards, a projection 39 thereof, which for the sake of clarity is only shown in FIG. 8, abuts against a projection 40 of the outer detent arm 22, said projection being only shown in FIG. 8 for the same reason, and rotates it into its working position shown in FIGS. 6 and 8, with the projection 40 of the outer detent arm 22 protruding therefrom to the right.

The projection 39 of the sole retainer 17 is here formed by a leaf spring which can only transmit a limited force to the projection of the outer detent arm 22. Although this spring is adequate to definitely rotate the outer detent arm from its released position back into its working position, it cannot transmit a great force which is detrimental to the blocking means 100 arranged in the part of the heel jaw 47 fixed to the binding plate. In the blocking state this blocking means 100 projects with a pin 411 into the path of travel of the outer support member 21 and inhibits the return thereof from its released position into its working position, whereby the return of the outer detent arm 22 from its released position is also prevented. When the blocking means is in the blocking position, locking of the sole retainer 17 is thus not possible.

When the outer detent arm 22 is turned backed, the inner detent arm 8 is also turned back via the shaft 7, whereby this arm abuts against the nose 37 of the inner lever 10 and turns this lever back as well. As a result, this lever comes again into contact with the detent surface 33 of the tilt armature 11 after it has been deflected from its inoperative position for a short time after its release from the solenoid 13, with the inner lever 10 sweeping over a ramp surface of the tilt armature 11. As a result, the jaw is again in its entry state.

The blocking means 100 or the variant 100' thereof and the evaluation arranged upstream thereof is expediently supplied by the battery provided for the circuit module, for which purpose corresponding leads are provided.

A viewing window 413 is outlined in FIG. 4 in connection with the blocking means 100, the carriage 408 serving at the same time as an indicator which when the blocking means 100 is in the blocking position is visible therein. The viewing window itself is expediently formed by a transparent insert provided in the housing of the blocking means.

The arrangement of the blocking means 100 shown in FIGS. 5 to 9 must only be regarded as an example in this embodiment of a jaw. For instance, the blocking means could just as well be integrated into the circuit module 44 and, for instance, prevent the armature 11 from returning from its attracted position into its released position or prevent the inner lever 10 from returning after a release into its inoperative position predetermined by the spring 35. Furthermore, it would also be possible to bring the armature itself into contact with the core with the aid of the blocking means 100, or variant 100' thereof, explained with the help of FIGS. 10, 10*a*, when said means passes from its release position into its blocking position, which would result in a release of the jaw.

However, with the last-mentioned variant, i.e. when the blocking means is operated unintentionally, for instance by means of a transmitter producing corresponding signals, the binding is unintentionally released and a fall can hardly be avoided.

By contrast, in the embodiments shown in the figures this need not be feared because even an activated blocking means 100 can only assume its blocking position after the binding has been released. The pin 411 of the blocking means 100 which is slidable into the path of travel of a catch or an abutment is here spring-biased towards its blocking position and, when the blocking means is activated, laterally adjacent this structural member and assumes its blocking position only when this member is in its released position.

The blocking means 100 and 100' respectively are now described in greater detail with the help of FIGS. 10, 10*a* and 11.

A transmitting circuit 200, a receiving circuit 300 which is adjusted to the signals thereof and also includes an evaluation circuit, as well as a locking circuit 400 are provided for triggering the blocking means.

The transmitting circuit 200 has a clock generator 201 which at the output side is connected to a shift register 202. This register is connected to a memory (not shown) loaded with a specific code or has such a memory itself. Upon operation of the signal button 203 the shift register 202 starts to output signals corresponding to the code at the rhythm predetermined by the clock generator 201, said signals being supplied via a final amplifier 204 to a transmitter such as an infrared transmitter 205.

The jaw has arranged therein a corresponding receiving circuit 300 which substantially consists of the receiver such as an infrared receiver 301, a preamplifier 302 arranged downstream thereof, and a clock recovery circuit 303 which is arranged downstream thereof and provided upstream of a shift register 304 already constituting a part of the evaluation circuit.

The incoming signals are supplied into the shift register 304 at the rhythm determined by the clock signals filtered out from the incoming signal mixture, the shift register forming the evaluation circuit together with the comparator 305 arranged downstream thereof, and the comparator being acted upon with the same code as the shift register 202 of the transmitting circuit 200. When there is correspondence between the code corresponding to the incoming signals and the stored code, this comparator outputs a signal. This signal tilts a flip-flop arranged downstream of the comparator, with the flip-flop producing a short pulse.

This pulse is supplied to the locking circuit 400 which substantially consists of a divider 401 for reducing the pulses in the ratio 1:2, and of two AND gates 402 and 403 and a commutator circuit 404 which is arranged downstream thereof and in the diagonal branch of which the coil 405 of the blocking means 100, 100' is located with current flowing therethrough in different directions.

The divider 401 and the inverting input of the AND gate 402 ensure that at each second signal of the comparator 305 the transistors of the same arms of the commutator circuit 404 switch through. Since the flip-flop 306 only outputs short pulses, the transistors of the commutator circuit can only switch through for a correspondingly short time as well so that the coil 405, too, is only acted upon with short pulses. This ensures a small power consumption, and the coil can thus be designed with correspondingly small dimensions and exposed to a high current load.

As can be seen from FIGS. 10, 10*a*, the coil 405 is surrounded by a magnetizable core 406 which is connected to pole pieces 407 of a magnetizable material. These pieces have lug-like heads in which an armature is displaceably guided. This armature has a land 409 formed by a permanent magnet magnetized in axial direction.

In the blocking means 100 according to FIG. 10 the armature is designed as a carriage 408 comprising a hollow sleeve which includes a bottom and at the one end of which another sleeve 410 is inserted, e.g. screwed in, a pin 411 which includes a land and which is biased towards its extended position by the spring 412 passing through this sleeve.

When current flows through the coil 405 by pulses, the magnetic field effects a corresponding polarization of the lug-like pole pieces 407 so that the permanent magnet 409 is repelled by the one pole and attracted by the other one. This effects a reversal of the carriage 408, whereby the blocking means 100 is moved into its blocking position and into its shown release position, respectively.

When the blocking means 100 is triggered in the sense of "blocking", the pin 411 abuts on the member 141 (FIGS. 1 to 4), 21 (FIGS. 5 to 9) which is to be blocked and belongs to the binding, whereby the spring 412 is compressed. As soon as this member 141, 22 reaches its release position, the spring 412 urges the pin 411 into the path of travel of this member and blocks, as has already been mentioned, the return thereof into its position allowing locking of the sole retainer 103, 17.

In the blocking means 100' according to FIG. 10*a*, the armature is formed as a full armature 408' which comprises a projection 411' provided at the end face and fulfills the same task as the pin 411 in the blocking means 100.

As far as the blocking means 100' is concerned, it is however expedient to arrange same in such a way that in both final positions of the member whose movement is to be inhibited the projection 411' can be slid past this member into the path of travel thereof. Otherwise, it would be necessary to keep the coil 405 excited until the full armature 408' can assume its corresponding final position, which is only the case when the member whose movement is to be inhibited has assumed a position allowing the sliding movement of the projection 411' past this member. This, however, would entail a corresponding energy demand of the coil at the expense of the battery supplying the binding.

The blocking means 100', however, is in particular suited for installation in the circuit module where it can be arranged such that it holds—together with the projection 411'—the tilt armature 11 in its attracted position. As a result thereof, the outer detent arm can no longer be held in its support position and an abutment for the tension spring 19 is therefore also missing, whereby locking of the sole retainer 17 is also not possible.

I claim:

1. In an anti-theft device for a safety ski binding comprising a jaw having at least one sole retainer adapted to be selectively brought into a detent position and into an open position, and at least one mechanically or electronically releasable detent means having a holding position for holding said sole retainer against a resilient force in said detent position and having a release position for permitting said sole holder to move to its open position free of said resilient force, the improvement comprising blocking means adapted to be selectively brought into an open or blocking position in response to control signals generated by a transmitting circuit and sent to a receiving circuit coupled to control means for controlling movement of said blocking means, and including means for permitting said blocking means to assume said blocking position only when said sole retainer is in said open position, wherein when said blocking means is in said blocking position said blocking means prevents said detent means from returning from said release position to said holding position.

2. An anti-theft device according to claim 1, wherein said transmitting circuit is separate from said binding and includes a shift register which is connected to a memory loaded with a specific code and to a clock generator, and which has an output in communication with a transmitter.

3. An anti-theft device according to claim 2, wherein said transmitting circuit includes a signal button coupled to said shift register and actuation of said button causes said shift register to output signals corresponding to said code loaded into said memory, and includes a final amplifier provided between said shift register and said transmitter, wherein said transmitter is an infrared transmitter.

4. An anti-theft device according to claim 1, wherein said control signals to said receiving circuit are transmitted wirelessly by said transmitting circuit, and wherein said receiving circuit includes a code evaluation circuit having a shift register and having a comparator which receives an output of said shift register, which is connected to a memory loaded with a specific code, and which outputs a pulse when there is correspondence between a received code in said control signal and said specific code.

5. An anti-theft device according to claim 1, wherein said control means comprises electromagnetic means responsive to signals from said receiving circuit for effecting movement of said blocking means between said open and blocking positions, said electromagnetic means effecting reciprocal movement of an armature which is said blocking means.

6. An anti-theft device according to claim 5, wherein said armature includes a single integral part which serves as a blocking member and includes a magnet which is provided on said blocking member and is responsive to electromagnetic fields generated by said electromagnetic means.

7. An anti-theft device according to claim 5, wherein said armature includes a movable sleeve having an opening therein, a magnet which is provided on said sleeve and is responsive to electromagnetic fields generated by said electromagnetic means, a blocking member movably supported within said sleeve, and a spring disposed within said sleeve and resiliently biasing said blocking member to move relative to said sleeve.

8. An anti-theft device according to claim 5, wherein said electromagnetic means includes a U-shaped core having a coil support portion extending between spaced pole-pieces, and a coil provided on said coil support portion, said blocking means being movably supported on said pole-pieces.

9. An anti-theft device according to claim 4, wherein said control means includes a locking circuit responsive to output pulses from said receiving circuit, said locking circuit including a divider for reducing the output pulses in the ratio of 1:2, and including two AND gates driven by said output pulses and by an output of said divider, and a commutator circuit driven by outputs of said AND gates and having a diagonal branch drivingly coupled to a coil of said blocking means, each pulse produced by said comparator of said receiving circuit toggling a flip-flop, said flip-flop outputting said output pulses supplied to said divider.

10. An anti-theft device according to claim 1, wherein said detent means is electrically released under control of an electric main circuit, and wherein said blocking means includes a break switch which is interconnected in said electric main circuit and which in the blocking position of said blocking means is in an "off" position.

11. An anti-theft device according to claim 1, wherein said jaw includes a release lever having a first member supported within said jaw for movement between locking and release positions in which it respectively facilitates and releases locking of said sole retainer in said detent position, wherein said blocking means acts in its blocking position on said first member to prevent travel of said first member of said from said release position to said locking position, said release lever including a hinge which is positioned in the interior of said jaw, which couples said first member thereof to a second member thereof, and which effects movement of said first member of said release lever by said second member thereof only in the direction from said locking position to said release position thereof.

12. An anti-theft device according to claim 1, wherein said detent means includes a support arm movable between first and second positions in which it respectively facilitates and interrupts said resilient force acting on said detent means, wherein said sole retainer is biased by a spring towards said open position and has thereon a leaf spring which, when said sole retainer is moved to said open position, engages a projection on said support arm and urges said support arm from said second to said first position thereof.

13. An anti-theft device according to claim 5, wherein said armature of said blocking means includes a carriage and includes a blocking member which is a pin movable relative to said carriage and adapted to be slid into the path of travel of a member of said detent means, said pin being biased to move relative to said carriage by a spring and said carriage being moved by said electromagnetic means, movement of said pin by said spring being limited by a stop provided on said carriage.

14. An anti-theft device according to claim 13, wherein said carriage is a sleeve having said pin movably supported therein, and said stop is a sleeve or bushing supported in said carriage.

15. An anti-theft device according to claim 1, wherein said blocking means includes indicators which are visible through a viewing window of said jaw to provide a visual indication of said open and blocking positions of said blocking means.

16. A ski binding, comprising: a sole retainer supported for movement between a holding position and an open position; retaining means for yieldably resisting movement of said sole retainer away from said holding position toward said open position; selectively actuable release means for disabling said retaining means so that sole retainer can move from said holding position to said open position substantially free of resistance by said retaining means; and selectively actuable blocking means for maintaining said retaining means in said disabled condition, said blocking means including means responsive to actuation of said blocking means for deferring said maintaining of said retaining means in said disabled position until a point in time when said retaining means is disabled by said release means.

17. A ski binding according to claim 16, wherein said retaining means includes a member movable between first and second positions, said member being in said first position when said retaining means is yieldably resisting movement of said sole retainer, and wherein movement of said member to said second position effects said disabling of said retaining means, and wherein said blocking means maintains said retaining means in said disabled condition by obstructing movement of said member from said second position to said first position thereof.

* * * * *

UNITED STATES PATENT AND TRADEMARK OFFICE

CERTIFICATE OF CORRECTION

PATENT NO. : 5,004,261

DATED : April 2, 1991

INVENTOR(S) : Klaus HOELZL

It is certified that error appears in the above-identified patent and that said Letters Patent is hereby corrected as shown below:

Column 13, line 10-11; delete "of said".

In the drawings please insert Figure 5 as shown below:

FIG. 5

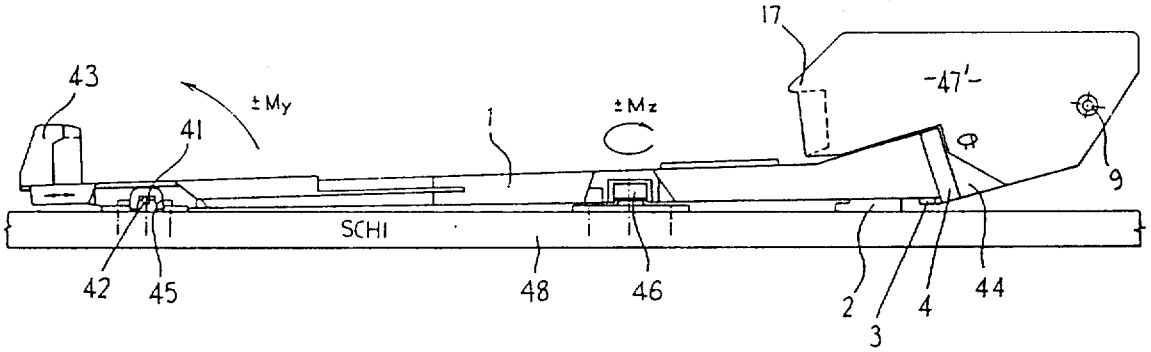

Signed and Sealed this

Third Day of November, 1992

*Attest:*

DOUGLAS B. COMER

*Attesting Officer*

*Acting Commissioner of Patents and Trademarks*